US005152116A

United States Patent [19]

MacGowan

[11] Patent Number: 5,152,116

[45] Date of Patent: Oct. 6, 1992

[54] MODULAR SHUTTER ASSEMBLY

[75] Inventor: Alan MacGowan, Walworth, Wis.

[73] Assignee: Selfix, Inc., Chicago, Ill.

[21] Appl. No.: 841,229

[22] Filed: Feb. 21, 1992

Related U.S. Application Data

[63] Continuation of Ser. No. 628,201, Dec. 14, 1990, abandoned.

[51] Int. Cl.[5] ..... E06B 7/08

[52] U.S. Cl. ..... 52/473; 52/309.1; 52/474; 52/202

[58] Field of Search ..... 52/309.1, 474, 473, 52/202

[56] References Cited

U.S. PATENT DOCUMENTS 3,158,909 1/1964 Downs ..... 52/202

4,251,966 2/1981 Foltman ..... 52/309.1

*Primary Examiner*—David A. Scherbel

*Assistant Examiner*—Wynn E. Wood

*Attorney, Agent, or Firm*—Dressler, Goldsmith, Shore, Sutker & Milnamow, Ltd.

[57] ABSTRACT

A shutter assembly of modular members molded or extruded from a polymeric material. Each of two side rails has a front wall and an inner wall defining a channel portion. Each of upper, and lower frame members and two louvered panel members has runners or mounting flanges extending along the sides thereof. The channel portion of each side rail has a base leg projecting from the side rail, a second leg projecting from the base leg, and a third leg projecting from the second leg toward the side rail. The third leg is spaced from the side rail by a distance approximating the mounting flange thickness when the channel portion is unstressed. The base leg flange has a groove defining a hinge. The channel portion defines a flexible mounting channel accommodating the mounting flanges despite minor dimensional variations.

8 Claims, 1 Drawing Sheet

Fig. 1
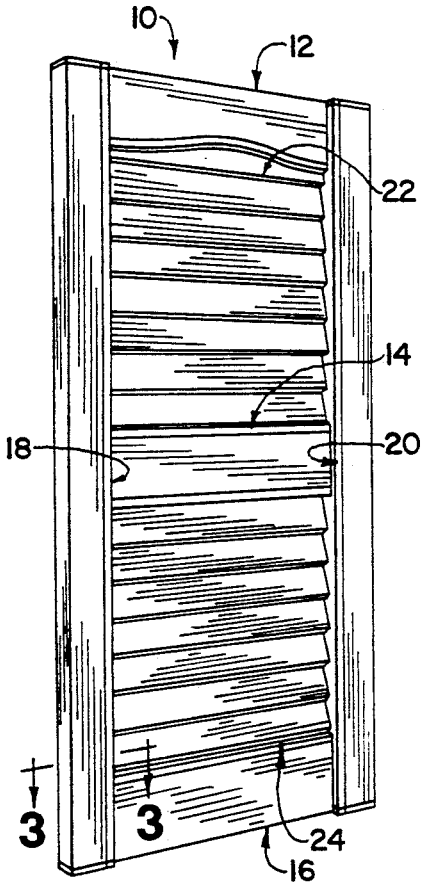
Fig. 2
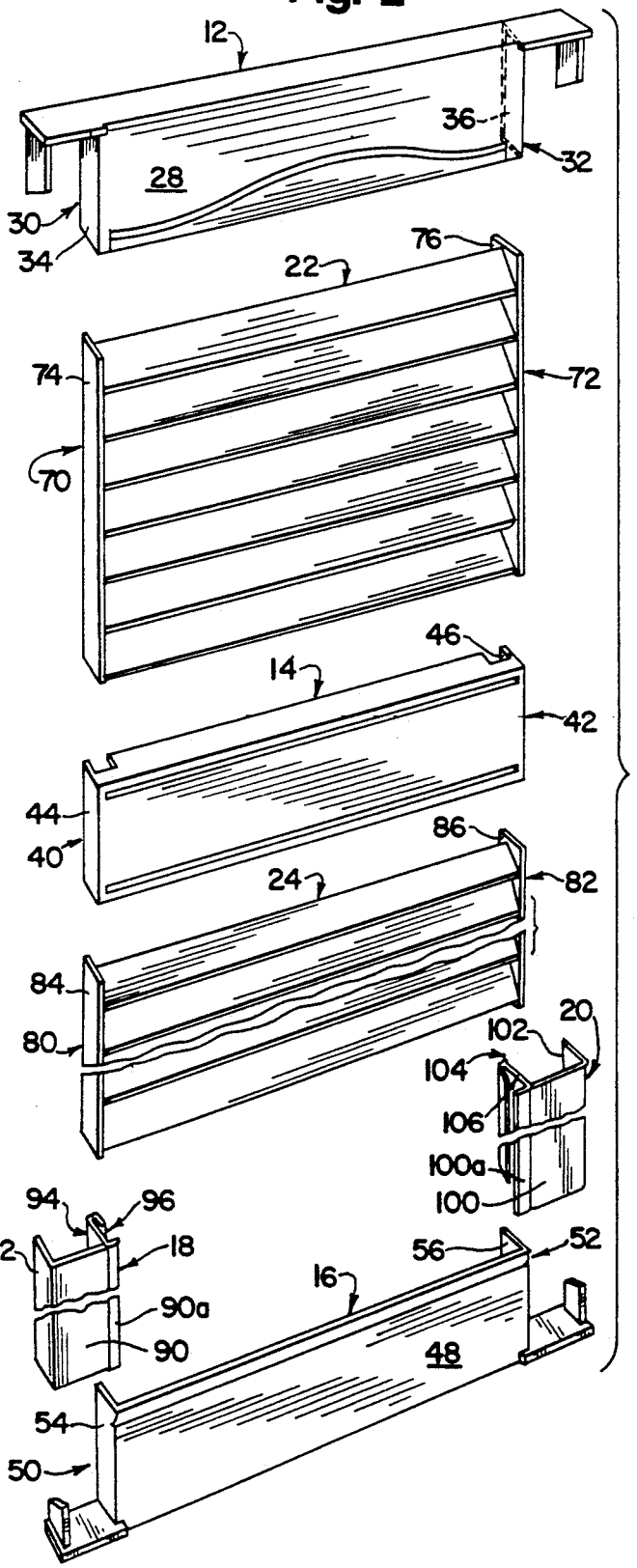
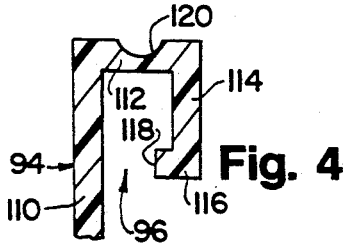
Fig. 4
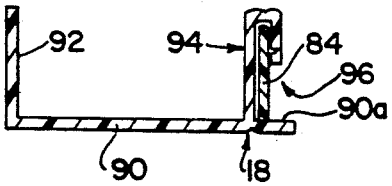
Fig. 3

MODULAR SHUTTER ASSEMBLY

This application is a continuation of application Ser. No. 07/628,201, filed Dec. 14, 1990, now abandoned.

FIELD OF THE INVENTION

This invention pertains to building shutters, and more particularly to adjustable modular shutter assemblies.

BACKGROUND OF THE INVENTION

There are a variety of decorative building shutter configurations of the type installed next to building openings, such as windows. Such shutters are constructed from various materials. Many are constructed as an integral units. One difficultly with such unitary types of shutters is that the size of the shutter often does not match the window or other building opening of a particular installation. As a result, other types of shutters exist which are assembled from modular components. These modular shutter assemblies are designed to be readily adjustable in size prior to assembly and therefore easily tailored for particular installations.

One such modular adjustable shutter assembly, constructed of plastic members is shown in Foltman U.S. Pat. No. 4,251,966. One difficulty with such constructions, particularly with modular members molded or extruded from a polymeric material, is that the dimensions of various components often vary, e.g., shrink, during cooling after molding or extruding. As a result, minor dimensional variations may be encountered.

Even minor dimensional variations may cause some of the components to fit too loosely or too tightly when assembled. If too tight, assembling components becomes difficult and time consuming. On occasion components may even be inadvertently broken during assembly. If the fit is too loose, the assembled shutter may not be sufficiently rigid or may rattle when in installed.

It would be desirable, therefore, to provide components for modular shutter assemblies which would accommodate variations in dimension while facilitating assembly and providing a generally good fit of components in spite of the dimensional variations that occur.

SUMMARY OF THE INVENTION

In accordance with the present invention there is provided a modular shutter assembly which includes a central panel member having generally planar runners on each side thereof, with the thickness of said runners being subject to minor dimensional variations. The shutter assembly also includes a pair of side rail members having front wall means and inner and outer side wall means, and runner receiving and retaining means associated with the inner side walls of said side rail members for receiving a runner of a central panel, and means for flexibly connecting said runner receiving and retaining means to each of said inner side walls of said side rail members to accommodate runners having dimensional variations without interference therebetween. The flexible connecting means biases at least a portion of said retaining means against a runner received thereby for retaining said runners in place independently of minor dimensional variations in the thickness thereof.

Shutters in accordance with the present invention are assembled from modular members, typically formed from a plastic material, such as, e.g., polypropylene or styrene. The modular members are constructed to facilitate effective assembly despite minor dimensional variations.

The modular members of shutters incorporating the present invention typically include a top rail or upper frame member, a bottom rail or lower frame member, one or more center panel members, which often take the form of louvered panel members, and a pair of side rails. When a plurality of center panel members are utilized, they are often separated by a center rail or intermediate frame member, e.g., a mullion.

In a shutter assembly incorporating the present invention, the frame and panel members are assembled to each of the side rails, with the top and bottom rails acting as end caps for the shutter assembly, as shown generally in the aforementioned Foltman U.S. Pat. No. 4,251,966, incorporated herein by reference. Each of the frame and panel members has a generally planar runner on each side thereof adapted to interact with runner receiving and retaining means formed as a part of each of the side rails.

The runner receiving and retaining means formed as part of each side rail defines in part a channel portion or mounting channel. Each mounting channel receives one end of a runner formed on the side of the other components, including the top rail or upper frame member, each center panel member, the bottom rail or lower frame member, and if used the center rail or intermediate frame member, typically located between center panel members.

The channel portion is flexibly connected to the side rail and defines an open end for receiving the end of a runner on the other components. The open end of the channel structure is biased towards the adjoining surface of the end rail to frictionally and resiliently engage and retain a runner inserted therein. The resilient channel structure accommodates dimensional variations in the thickness of the runners. In addition, by use of the biased and resilient channel structure to receive, engage and retain the runners therein, the closed end of the channel structure need not be relied on to retain the runner in place, and therefore, can be enlarged to further accommodate dimensional variations, both in the runner and in the channel structure.

More specifically, the channel portion includes a base or first leg formed integrally with and projecting from side rail to form the base of the channel. The channel includes a second, channel defining side leg extending from the free end of the base leg and projecting generally parallel to and in spaced relation to the body of the side rail. A hook or end prong projects from the free end of second side leg pointed towards the side rail. The end prong terminates at a point spaced from the side rail by a distance approximating the thickness of the runners. The channel portion has sufficient flexibility to enable the mounting channel to accommodate minor dimensional variations in the runners received therein. The flexible channel structure is normally biased to bear against the surface of the runners to retain them in place. At the same time, the flexibility of the channel structure accommodates runners without binding when the runners are thicker than expected or the size of the channel gap is reduced.

The desired flexibility can be achieved by forming one of the legs with a groove defining a hinge. Preferably, the base leg is formed with the hinge groove, often referred to as a living hinge.

Numerous other advantages and features of the present invention will become readily apparent from the following detailed description of the invention and an embodiment thereof, from the claims, and from the accompanying drawings in which the details of the invention are fully and completely disclosed as a part of this specification.

BRIEF DESCRIPTION OF THE DRAWINGS

FIG. 1 is a perspective view of a shutter assembly the present invention;

FIG. 2 is an enlarged, exploded, perspective view of the shutter assembly of FIG. 1;

FIG. 3 is an enlarged, fragmentary, sectional view taken along line 3—3 of FIG. 1 in a direction indicated by arrows; and FIG. 4 is an enlarged, fragmentary, sectional detail taken from FIG. 3.

DETAILED DESCRIPTION OF PREFERRED EMBODIMENT

While this invention is susceptible of embodiment in many different forms, there is shown in the drawing and will be described herein in detail, a specific embodiment thereof, with the understanding that the present disclosure is to be considered as an exemplification of the principles of the invention and is not intended to limit the invention to the specific embodiment illustrated.

As shown in FIG. 1, shutter assembly 10 is made of a plurality of modular members with improved mounting features enabling the shutter to be effectively assembled despite minor dimensional variations among the modular members.

The modular members which make up the shutter assembly 10 include a top rail or upper frame member 12, a center rail or intermediate frame member 14, a bottom rail or lower frame member 16, and left and right side rails 18, 20, respectively. The shutter assembly also includes an upper center panel member 22 and a lower center panel member 24. As shown in the drawings, the panel members 22, 24, are louvered.

The side rails 18, 20, are extruded from a polymeric material, such as styrene or polypropylene, which is preferred. The other components are molded from the same material. Such material tends to shrink when cooled after extruding or molding. The modular members may be suitably colored and may be so formed as to have a simulated wood grain on their surfaces that remain exposed in normal use of the shutter assembly 10.

The upper frame member or top rail 12 has a central portion 28 which has two sides 30, 32. The sides 30, 32 define runners or mounting flanges 34, 36, respectively extending the length thereof. The center rail or intermediate frame member 14 has two sides 40, 42, which define runners or mounting flanges 44, 46, respectively extending along the length thereof. The bottom rail or lower frame member 16 has a central portion 48 which has two sides 50, 52 defining runners or mounting flanges 54, 56 extending the length thereof.

The upper center panel member 22 has two sides 70, 72 defining runners or mounting flanges 74, 76 extending the length thereof, and the lower center panel member 24 has two sides 80, 82 defining runners or mounting flanges 84, 86 extending the length thereof. The runners or mounting flanges of the various components have similar thicknesses, e.g. 0.08 inch +/− 0.005 inch.

The left side rail 18 has a front wall 90, an outer side wall 92, and an inner side wall 94. The inner side wall 94 is spaced laterally from the outer side wall 92 and defines a runner receiving and retaining means in the form of an inwardly extending front wall extension 90*a* and a mounting channel 96. The right side rail 20 is similar to the left side rail 18 and defines a front wall 100, with an inwardly extending front wall extension 100*a*, an outer side wall 102, and an inner side wall 104, which defines a mounting channel 106 similar to the mounting channel 96.

The channel 96 comprises a first leg 110 formed by inner side wall 94, a second base leg 112, a third outer leg 114, and an end prong 116. The base leg 112 projects from the inner side wall 94 perpendicularly therefrom when the channel 96 is unstressed. The outer leg 114 projects from the base leg 112 perpendicularly when the channel 96 is unstressed. The end prong 116 projects from the side leg 114 toward the first flange 110 and projects perpendicularly when the channel portion 92 is unstressed. The distal end 118 of end prong 116 is spaced from the side wall 94 when the channel portion 92 is unstressed by a distance, e.g. approximately 0.072 inch, which approximates the thickness of the runners or mounting flanges, or is slightly less. The base leg 112 has a groove 120 formed therein defining a hinge. Commonly, such a hinge is called a living hinge.

When the shutter 10 is assembled, the mounting flanges 34, 44, 54, 74, and 84 are received in the mounting channel 96, and the mounting flanges 36, 46, 56, 76, and 86 are received by the mounting channel 106.

Because of the hinge defined by the groove 120 extending along the base 112, the channel portion 92 of the side rail 18 has sufficient flexibility to accommodate the mounting flanges received by the channel 96 despite minor dimensional variations among the modular members assembled to provide the shutter 10. Being formed similarly, the channel portion 104 of the side rail 20 has comparable flexibility.

A condition wherein minor dimensional variations among the modular members requires the channel portion 94 of the side rail 18 to flex so that the mounting channel 96 can accommodate the mounting flange 84 of the lower panel member 24 is exemplified in FIG. 3.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. A modular shutter comprising a pair of side rail members having front wall means, inner side wall means, and outer side wall means, said pair of side rail means being spaced apart one from the other with said inner side wall means thereof lying in generally parallel planes;

a central member disposed between said side rail members and having a pair of opposed side edges, each of said side edges disposed adjacent a corresponding one of said inner side wall means of one of said pair of side rail members, each of said side edges including generally planar runner means oriented generally parallel to the plane of said inner side wall means;

each of said inner side wall means including runner receiving and retaining means for slidably receiving one of said generally planar runner means of said central member;

said retaining means including a front member adjacent the intersection of said side wall means and said front wall means for engaging the forward edge of a corresponding one of said generally planar runner means, and a rear member adjacent the rear edge of said inner side wall means for engaging the rear edge of a corresponding one of said generally planar runner means;

at least one of said front and rear members including additional wall means spaced from said inner wall means having a free end and defining therebetween an open ended channel for slidably receiving and retaining a corresponding one of said generally planar runner means with the free end of said additional wall means and the open end of said channel facing the other of said front and rear members; and means forming the closed end of said channel and including flexible connecting means for flexibly connecting said additional wall means to the inner side wall means at a point adjacent to said side wall means remote from the open end thereof, and flexible connecting means facilitating slidably passage of said generally planar runner means in said retaining channel between said front and rear members for accommodating the end of said generally planar runner means in contact therewith and biasing said free end of said additional wall means against the surface of said generally planar runner means for retaining said generally planar runner means in place.

2. A modular shutter as claimed in claim 1 wherein said additional wall means is spaced from said inner side wall means at the closed end of said channel by a distance greater than the thickness of said generally planar runner means.

3. A modular shutter as claimed in claim 2 wherein said free end of said additional wall means is spaced from said side wall means by a distance less than the thickness of said generally planar runner means at the open end of said channel.

4. A modular shutter as claimed in claim 1 wherein said flexible connecting means flexes in response to engagement by the end of a generally planar runner means slidably inserted in said channel to minimize binding interference therebetween during assembly of said shutter.

5. A modular shutter as claimed in claim 1 wherein said flexible connecting means includes and end wall having a flexible portion and interconnecting said additional wall means to said inner side wall means at the closed end of said channel.

6. A modular shutter as claimed in claim 5 wherein said flexible portion of said end wall flexes in response to engagement by the end of a generally planar runner means slidably received within said channel to minimize binding interference therebetween during assembly of said shutter.

7. A modular shutter as claimed in claim 6 wherein said free end of said additional wall means is spaced from said side wall means by a distance less than the thickness of said generally planar runner means at the open end of said channel, and said flexible portion of said end wall flexes in response to engagement by the free end of said additional wall means with the surface of a generally planar runner means slidably received with said channel and having a thickness greater than said free end spacing.

8. A modular shutter comprising a pair of side rails including a front wall, an inner side wall and an outer side wall, said pair of side rails being spaced apart one from the other with the inner side wall thereof facing each other and lying in generally parallel planes;

a central member disposed between said side rail members and having a pair of opposed side edges, each of said side edges being disposed adjacent to a corresponding one of said inner side walls and each including a generally planar runner oriented in a plane generally transverse to the plane of said central member and generally parallel to the plane of said inner side walls; and each of said inner side walls including a runner receiving and retaining means for slidably receiving one of said generally planar runners of said central member, said receiving and retaining means including:

a generally planar front member adjacent the intersection of said inner side wall and said front wall and extending inwardly from said side rail for engaging the forward edge of the adjacent generally planar runner, and a generally U-shaped open-ended runner retaining channel formed adjacent the rear edge of said inner side wall for engaging the rear edge of said runner;

said U-shaped open-ended channel being defined by an additional wall having a free end and spaced from said inner wall housing to define therebetween said U-shaped open-ended channel for slidably receiving and retaining the back end of corresponding one of said generally planar runners with the free end of said additional wall and the open end of said U-shaped channel facing the planar front member of said runner retaining means; and an end wall flexibly interconnecting said additional wall to said inner side wall at the closed end of said U-shaped open-ended channel and for spacing said additional wall from said inner side wall by a distance greater than the thickness of said generally planar runner at the closed end of said U-shaped open-ended channel; and said end wall flexibly biasing said additional wall toward said inner side wall to position the free end thereof away from said inner side wall by a distance less than the thickness of said generally planar runner, the flexible portion of said end wall flexing in response to engagement therewith by the end of a generally planar runner inserted into said channel.

* * * * *